US007428825B2

(12) United States Patent
Förster et al.

(10) Patent No.: US 7,428,825 B2
(45) Date of Patent: Sep. 30, 2008

(54) MANIFOLD FOR COOLING AGENT, HEAT EXCHANGER, COOLING AGENT CLOSED CIRCUIT AND METHOD FOR PRODUCING A MANIFOLD

(75) Inventors: Uwe Förster, Erdmannhausen (DE); Kurt Molt, Bietigheim-Bissingen (DE); Gerrit Wölk, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 464 days.

(21) Appl. No.: 10/525,325

(22) PCT Filed: Aug. 19, 2003

(86) PCT No.: PCT/EP03/09162

§ 371 (c)(1),
(2), (4) Date: Feb. 22, 2005

(87) PCT Pub. No.: WO2004/025195

PCT Pub. Date: Mar. 25, 2004

(65) Prior Publication Data

US 2005/0268643 A1 Dec. 8, 2005

(30) Foreign Application Priority Data

Aug. 31, 2002 (DE) ..... 102 40 303

(51) Int. Cl.
*F25B 43/00* (2006.01)

(52) U.S. Cl. ..... 62/474; 62/509

(58) Field of Classification Search ..... 62/474, 62/509, 195; 55/282.2, 282.5
See application file for complete search history.

(56) References Cited

U.S. PATENT DOCUMENTS

| | | | | |
|---|---|---|---|---|
| 6,223,556 | B1 * | 5/2001 | De Keuster et al. | 62/509 |
| 6,308,410 | B1 | 10/2001 | Sabathie | |
| 6,341,647 | B1 * | 1/2002 | Nobuta et al. | 165/132 |
| 6,446,463 | B2 * | 9/2002 | Bernini | 62/473 |
| 6,622,517 | B1 * | 9/2003 | Whitlow et al. | 62/474 |

FOREIGN PATENT DOCUMENTS

| | | | |
|---|---|---|---|
| CN | 1187564 | C | 2/2005 |
| DE | 199 26 990 | A1 | 12/1999 |
| DE | 102 13 194 | A1 | 10/2003 |
| EP | 0 709 644 | A2 | 5/1996 |
| EP | 0 816 779 | A1 | 1/1998 |
| EP | 0 936 423 | A2 | 8/1999 |
| EP | 1 193 455 | A1 | 4/2002 |
| EP | 1 193 455 | B1 | 4/2002 |
| FR | 2 735 856 | A1 | 12/1986 |
| JP | 57-019593 | A | 2/1982 |
| JP | 2001-041612 | A | 2/2001 |

OTHER PUBLICATIONS

Patent Abstracts of Japan, vol. 1998, No. 06, Apr. 30, 1998, JP 10-047811, Feb. 20, 1998.
Patent Abstracts of Japan, vol. 2000, No. 22, Mar. 9, 2001, JP 2001-141332, May 25, 2001.
Patent Abstracts of Japan, vol. 2000, No. 19, Jun. 5, 2001, JP 2001-041612, Feb. 16, 2001.

* cited by examiner

*Primary Examiner*—Melvin Jones
(74) *Attorney, Agent, or Firm*—Foley & Lardner LLP

(57) ABSTRACT

The invention relates to a manifold for a cooling agent of an air conditioning plant which comprises a separation form-closed element fixed inside a manifold housing, a heat exchanger provided with said manifold, the closed cooling agent circuit of the air conditioning plant with the manifold and a method for producing said manifold.

30 Claims, 8 Drawing Sheets

Figure 1:
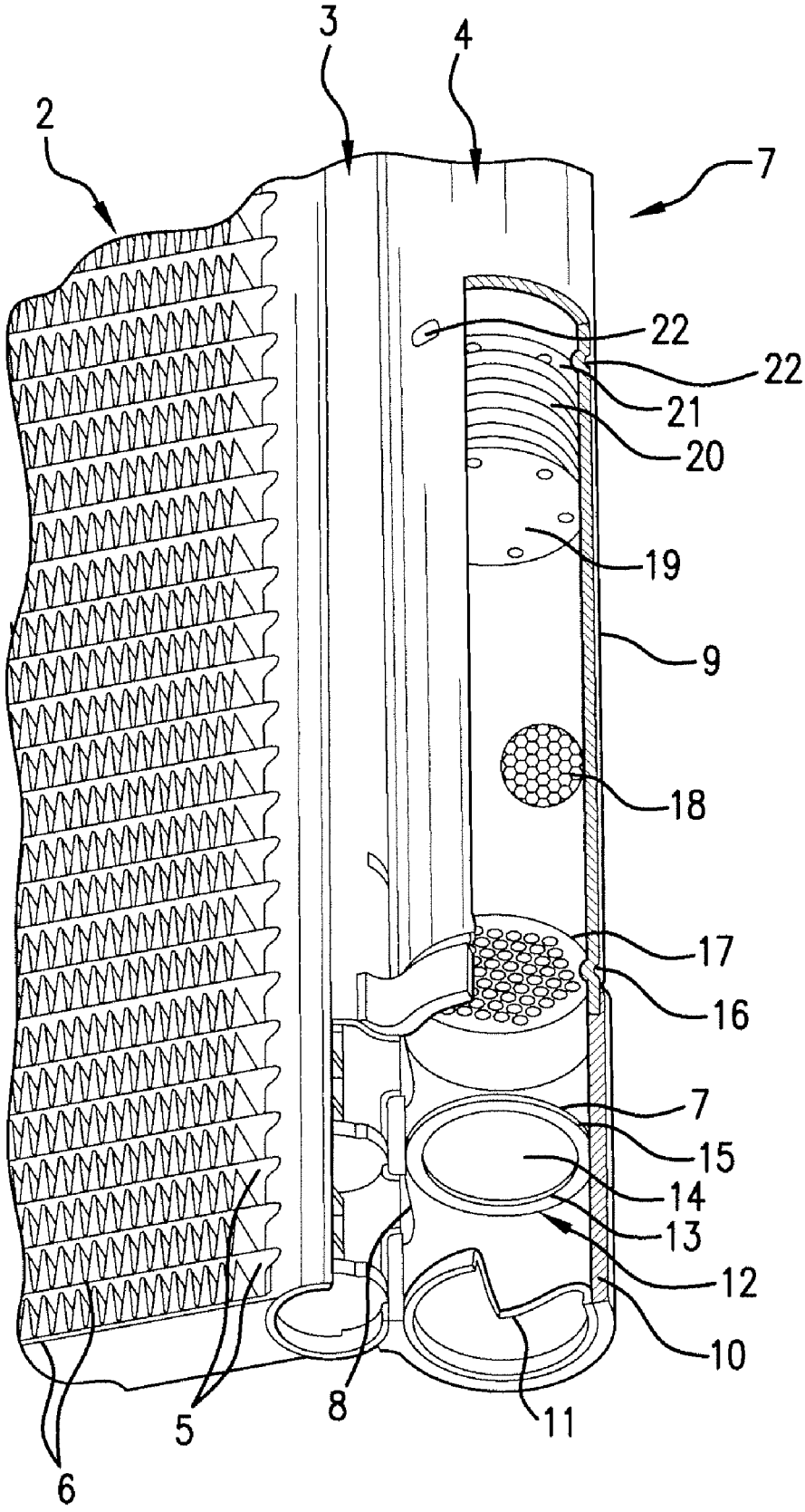

MANIFOLD FOR COOLING AGENT, HEAT EXCHANGER, COOLING AGENT CLOSED CIRCUIT AND METHOD FOR PRODUCING A MANIFOLD

The invention relates to a header for a refrigerant of an air conditioning system, with a housing, with a chamber and with a refrigerant-permeable separation element, and also to a heat exchanger with such a header and to a refrigerant circuit of an air conditioning system with such a header. The invention also relates to a method for the production of such a header.

Heat exchangers with such headers are described in the applicant's older patent application DE 102 13 194. In the subject of the applicant's older application, a portion of the header is used to receive the drier granulate, the header portion being delimited upwardly and downwardly by perforated plates. This solution has the advantage that a separate drier container does not have to be inserted into the header, and that the drier can be soldered together with the entire refrigerant condenser, that is to say does not have to be inserted at a later date, after the soldering process, into the header which would subsequently have to be closed. The disadvantage of the solution illustrated and described in the older application is that the header is widened in the region of the drier portion, that is to say has a larger cross section in relation to the adjacent portions. This signifies an outlay in manufacturing terms which entails additional costs.

The object of the present invention is to improve a header according to the subject of the older application to the effect that it can be produced more simply and more cost-effectively. The object of the invention is also to specify a cost-effective method for the production of a header.

This object is achieved by means of a header having the features of claim 1, by means of a heat exchanger or refrigerant condenser having the features of one of claims 14 and 20, by means of a refrigerant circuit having the features of claim 15 and by means of a method for the production of a header having the features of one of claims 16 to 19 and 31.

According to claim 1, a header for a refrigerant of an air conditioning system has a housing with an inlet and an outlet orifice, a chamber for receiving the refrigerant and at least one refrigerant-permeable separation element, the separation element separating a first and a second region of the chamber from one another.

Advantageously, an inner wall of the housing has one or more, in particular continuous or singly or multiply interrupted projections or depressions for supporting the separation element. It is thereby possible for one or more separation elements to be supported on the inner wall of the housing, or to be fixed with respect to the inner wall, in the header by means of such stop faces or abutments, without the external configuration of the header being appreciably influenced for this purpose. The header housing can thus be produced in a simple way, for example from a welded tube of constant cross section, to the inner wall of which, in particular, the projections are attached by means of simple tools.

According to an advantageous embodiment of the invention, the separation element has a filter or is designed as a filter, so that the first region of the chamber forms a return-flow chamber communicating with the inlet orifice and the second region forms a forward-flow chamber communicating with the outlet orifice. By the refrigerant being filtered, an adverse entrainment of particles in a refrigerant circuit is hindered.

Particularly preferably, the filter comprises a filter fabric which has a reinforced edge region and/or is set in a frame connectable to the housing. The filter thereby has increased stability, as a result of which, in particular, it becomes easier for the filter to be mounted in the housing.

According to a further advantageous embodiment, a drier can be received in the first region, so that water can be extracted from the refrigerant which flows through the header. The first region of the chamber consequently becomes the drier region. The drier in this case takes the form, in particular, of granulate or powder and is fixed in the drier region by means of at least one separation element.

Preferably, the separation element has a sieve or is designed as a sieve. An escape of, in particular, abrasion particles from the drier region into the second region of the chamber is thereby prevented. Particularly preferably, the sieve has a reinforced edge region and/or is set in a frame connectable to the housing. The sieve thereby has increased stability, as a result of which, in particular, it becomes easier for the sieve to be mounted in the housing.

According to an advantageous development, the drier can be fixed in the first region by means of a force accumulator, such as, for example, a compression spring or a cup spring. A slipping out of place and, if appropriate, an abrasion of the drier are thereby prevented or at least restricted. Particularly preferably, a force which is exerted by the force accumulator on the, in particular, granular or pulverulent drier is transmitted to the drier with the aid of a force distributor, such as, for example, a pressure plate, so that the force acts, equally distributed, on the drier.

According to an advantageous embodiment of the invention, the housing consists of at least two parts, the separation element being held in a joint between two housing parts, thus resulting in a particularly simple type of construction of the header. According to an exemplary embodiment, in this case, the joint is covered on the outside of the housing by means of a covering, such as, for example, a sleeve. In a further exemplary embodiment, the two housing parts can be plugged one into the other in such a way that the joint is covered outwardly by at least one of the two housing parts.

According to a preferred embodiment, the separation element can be supported against movement away from the first region. In particular, in the case of a first chamber region designed as a drier region, a drier can thus be received in the first region.

According to a preferred embodiment, the separation element can be supported against movement toward the first region. A support of the separation element against movement away from the first region and against movement toward the first region is particularly preferred.

According to a preferred embodiment, the separation element can be supported by means of a force accumulator, such as, for example, a compression spring, a cup spring or a securing ring. This serves for a simplified mounting of the separation element which is held by such a prestressed force accumulator.

According to an advantageous embodiment, the separation element is connected in a materially integral manner, in particular soldered, to the housing. Particularly advantageously, the separation element can be soldered to the housing or, in particular, to the heat exchanger in one operation, so that production is simplified, since there is no need at a later stage to insert or connect the separation element into or to the housing.

According to a further embodiment, a simple type of construction is afforded by a tubular housing having, in particular, a round cross section. The end faces of the tube are preferably closed, at least one inlet orifice and at least one outlet orifice then being arranged elsewhere.

According to an advantageous development of the invention, the projections are designed as a continuous bead, that is to say as a contraction of the header cross section. Alternatively, this bead may also be interrupted on the circumference, thus resulting only in individual bead segments or knob-like projections which are suitable for functioning as abutments for the inserts.

According to an advantageous development of the invention, the two inserts are loaded by a compression spring which is arranged between them and which presses via a moveable pressure plate onto the granulate and keeps the latter under compressive stress.

In a further embodiment of the invention, the low insert may be designed as a perforated plate or as an annular sieve which is supported on the projections or a continuous bead and which can additionally be soldered circumferentially. This results in 100% leaktightness in the edge region, so that no particles, for example granulate abrasion, penetrate into the lower header space.

According to a further advantageous embodiment of the invention, the upper insert may be as far as possible open and be designed as a perforated plate or ring which is supported on the projections. The upper insert therefore does not have to seal off, but form merely an abutment for the compression spring which presses onto the pressure plate moveable in the header.

According to an advantageous development of the invention, in the lower region of the header, that is to say between the two overflow orifices, an annular sieve is arranged, that is to say a planar sieve fabric which is framed circumferentially by a ring fastened in the header, whether in a groove or by means of a frictional connection, for example by pressing as a result of an increase in diameter of the ring. This filter sieve has the advantage of a constant mesh width, as compared with a cup-shaped sieve (according to the older application). Fine particles are thereby retained in the header. This ring, too, may be soldered circumferentially to the header inner wall, in order to achieve one hundred percent leaktightness in this region.

According to an advantageous development, a header according to the invention is inserted into a heat exchanger with tubes, ribs and two headpieces and/or into a refrigerant circuit of an air conditioning system with a compression element, with a first heat exchanger, with an expansion element and with a second heat exchanger.

The object of the invention is also achieved by means of a method having the features of one of claims 16 to 19 and 31. This method has the advantage that the drier, which, in particular, is also to be soldered, can be mounted and fixed in the header in a simple way. This takes place, for example, after the insertion of a drier, essentially in that an insert is pressed down, for example by means of a suitable tool, and a force accumulator is put under prestress and is subsequently fixed in the prestressed state, in that, above it, one or more projections are introduced into the housing inner wall, the insert subsequently coming to bear against the projections. The drier is consequently ready-mounted in the header. The pressed-down insert is in this case either the separation element or a force distributor or a housing wall.

Hence, in the method according to the invention, only one tool, for example a ram, for generating a prestress and one further tool which acts from outside and is coordinated with the first tool and which attaches the projections in the header are required. These are simple and reliable method steps which allow a cost-effective production of the header together with solderable drier.

Figure 5:
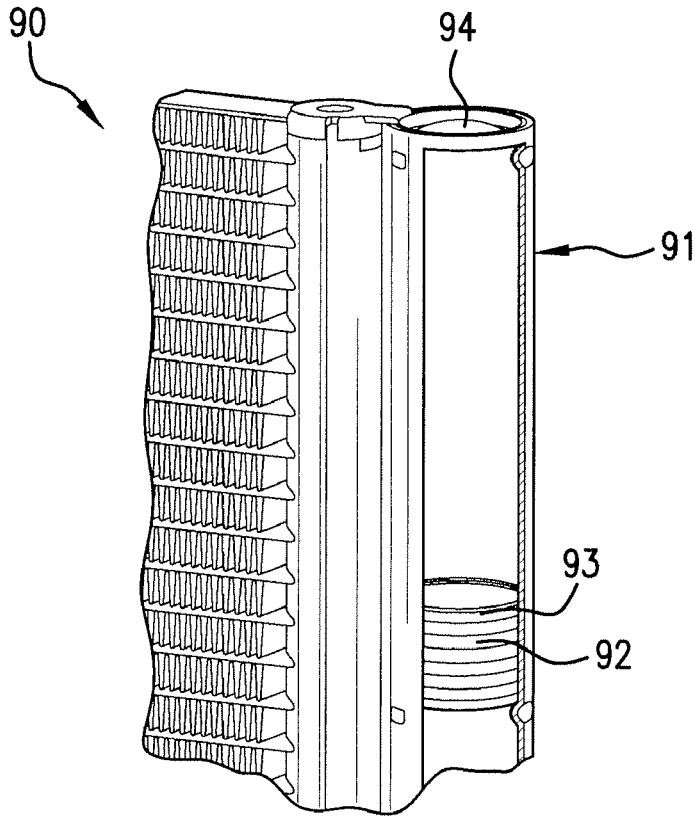
Figure 6:
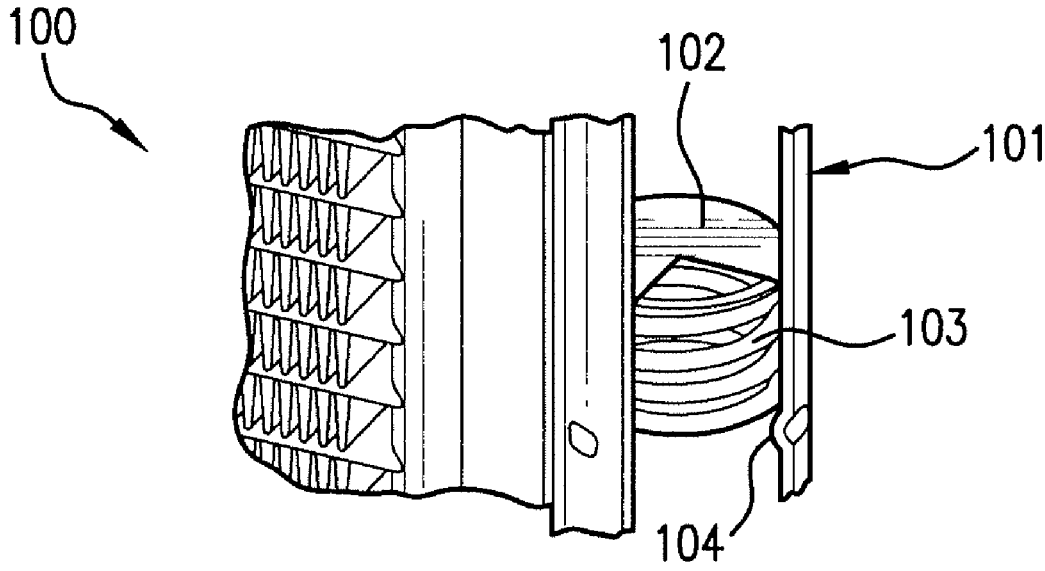
Figure 7:
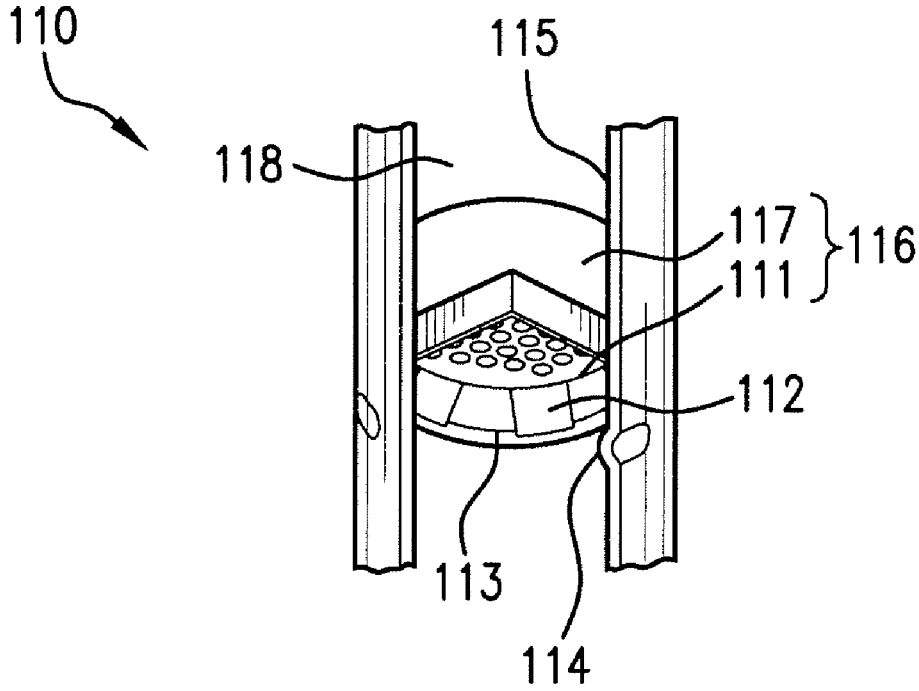
Figure 8:
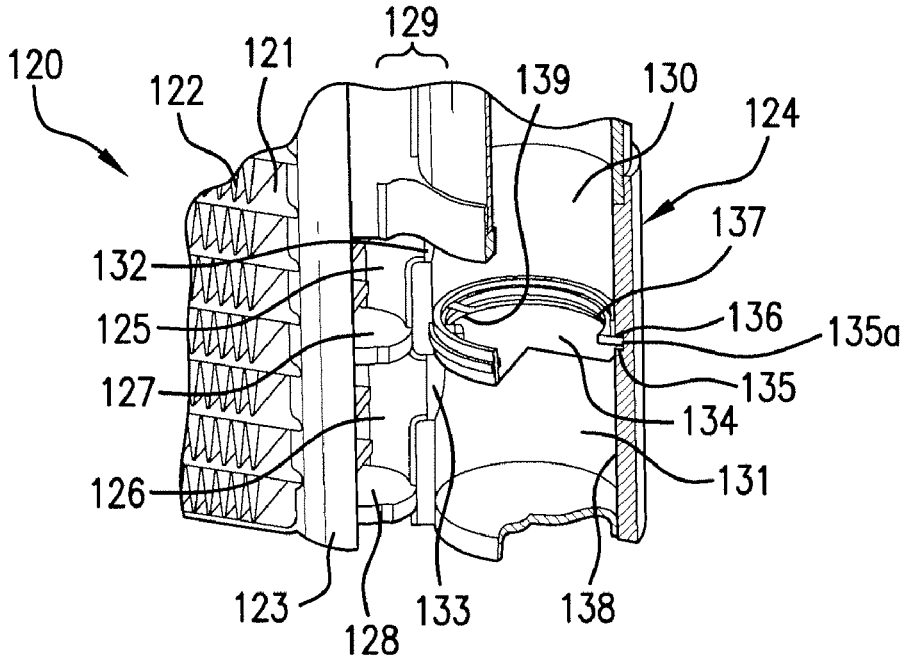
Figure 9:
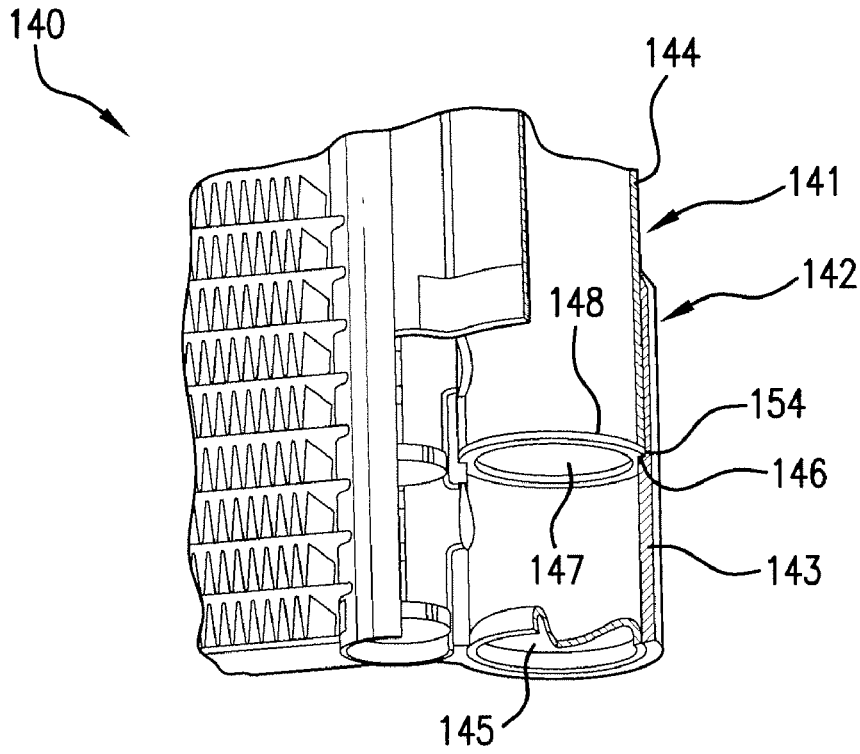
Figure 12:
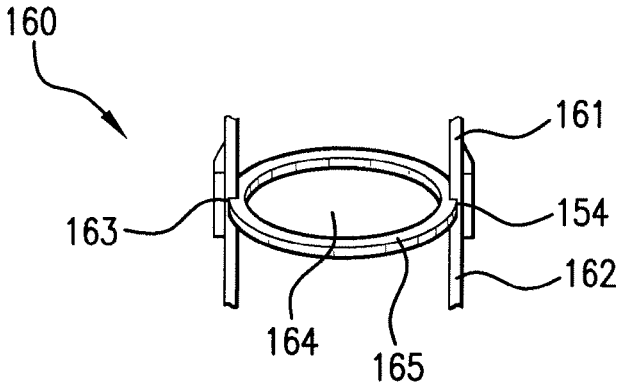
Figure 13:
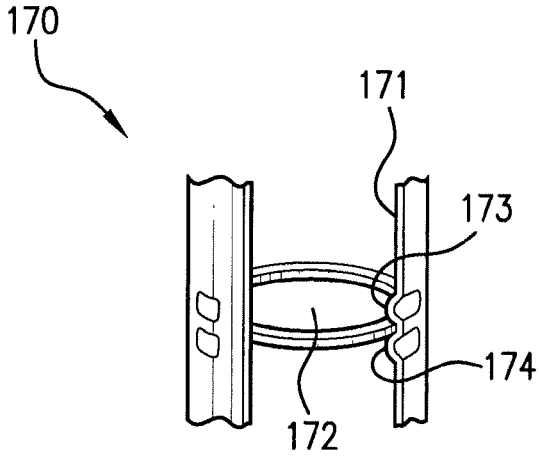
Figure 14:
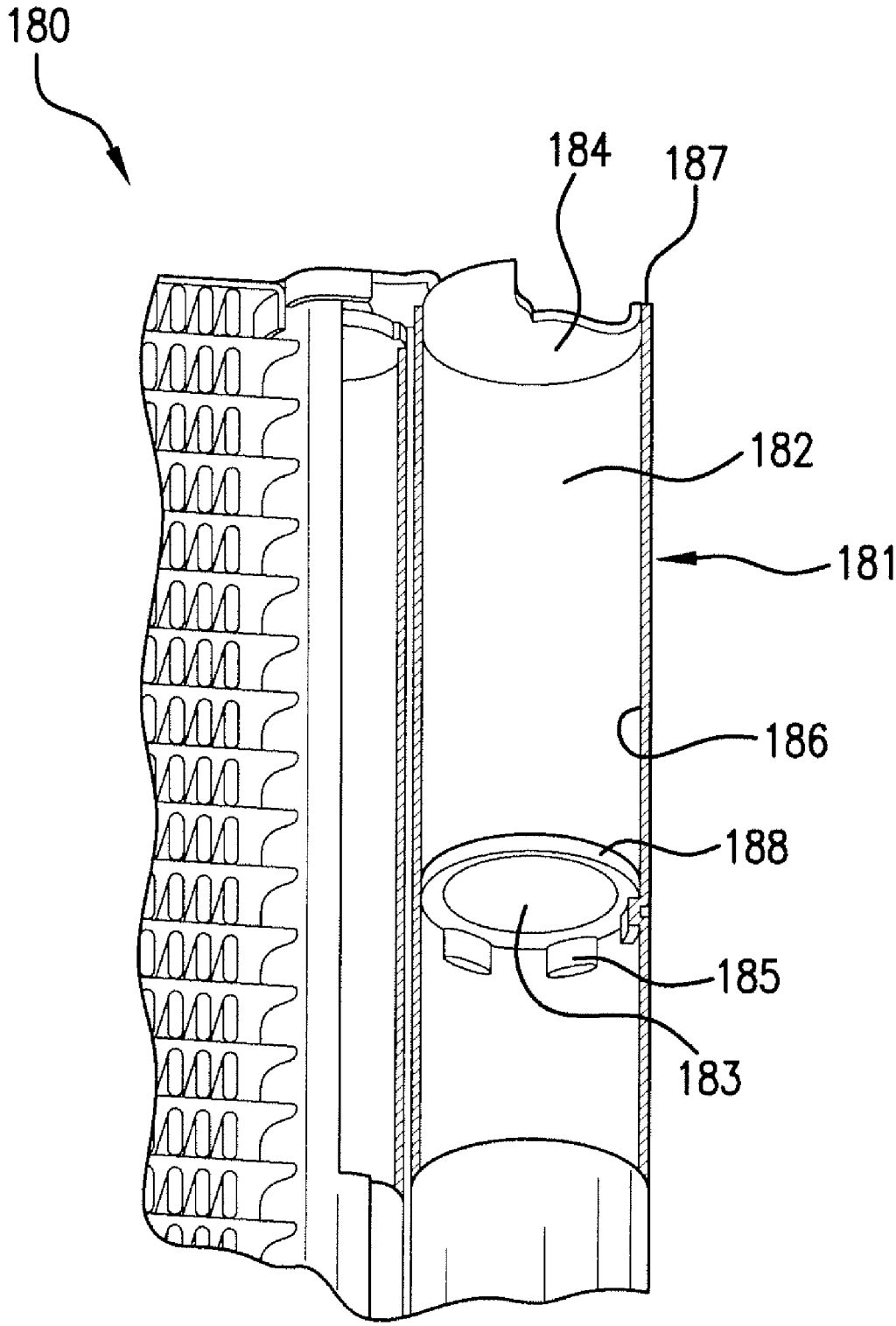
Figure 15:
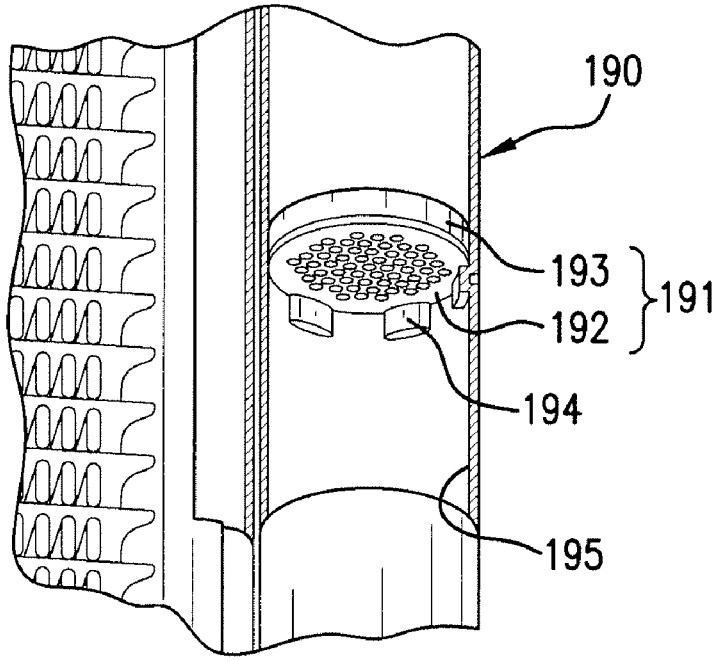
Figure 16:
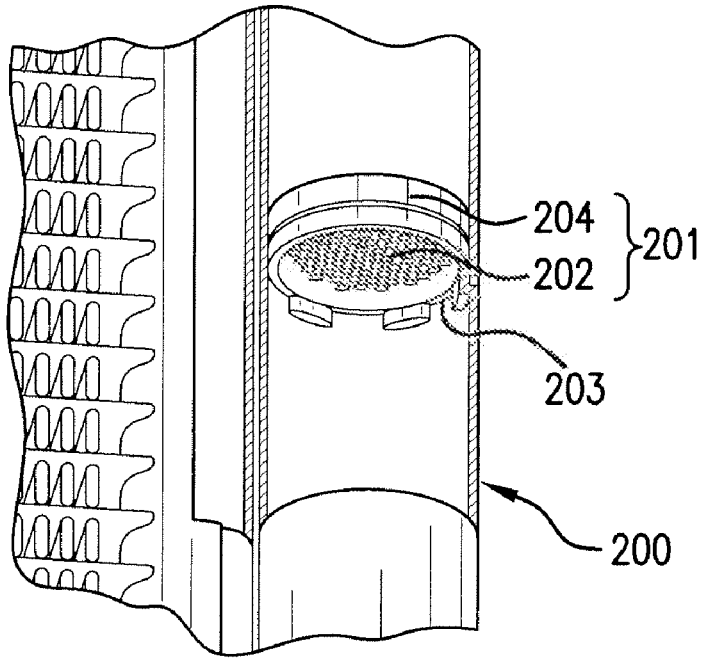

The invention is explained in more detail below by means of exemplary embodiments, with reference to the drawings in which:

FIGS. 1-6 show in each case a detail of a heat exchanger with a header according to the present invention, FIG. 7 shows a detail of a header, FIGS. 8-9 show in each case a detail of a heat exchanger with a header, FIGS. 10-13 show in each case a detail of a header, and FIGS. 14-16 show in each case a detail of a heat exchanger with a header.

FIG. 1 shows a perspective illustration of an only partially illustrated refrigerant condenser 1, a heat exchanger network 2, a header tube 3 and a header 4 being partially illustrated. The refrigerant condenser 1 corresponds in construction as far as possible to the refrigerant condenser according to the older application bearing the file number 102 13 194.5, which in full becomes the subject of this application, that is to say is fully incorporated into the disclosure of the invention.

The heat exchanger network 2 consists of flat tubes 5, the ends of which are received by the header tube 3 and between which corrugated ribs 6 are arranged. The header tube 3 and the header 4 are arranged parallel to one another and, as is known from the older application, are connected mechanically and fluidically to one another, that is to say by two overflow orifices 7 and 8, via which the refrigerant passes from the header tube 3 into the header 4 and flows out of the latter back into the header tube 3 again. The header 4 is composed of a tubular piece 9, for example a welded tube, and of an extruded profile 10 which has the overflow orifices 7, 8 and which is closed on the end face by means of a cover 11.

The header 4, consisting of the tube 9 and profile 10, has approximately a circular cross section and is cut open in the illustration, in order to allow a look into its interior. There, in the region between the two overflow orifices 7, 8, a filter in the form of an annular sieve 12 is arranged, which consists of an outer ring 13 and of an inner planar sieve fabric 14 framed by the ring 13. The ring 13 is held positively in a groove 15 of the profile 10 and can be soldered to the profile 10. The annular sieve 12 is mounted by the annular sieve 12 being introduced with slight radial play into the profile 10 until it has reached the annular groove 15. The ring 13 is then anchored in the annular groove 15 by means of an increase in diameter, for example by pressing. Frictional fastening of the ring 13, without an annular groove 15, would likewise be possible.

The tubular piece 9 has arranged in it a continuous inwardly directed bead 16 which results in a narrowing of the tube cross section. The bead 16 may be introduced into the tubular piece 9 before the tubular piece 9 is connected to the profile 10. Instead of this continuous bead 16, individual bead segments or knob-like projections distributed over the circumference are also possible. Above the bead 16, a perforated plate 17 is arranged, that is to say it lies on the bead 16 which forms an abutment for the perforated plate 17. The perforated plate 17 can be soldered to the tubular piece 9 circumferentially at a later stage. Above the perforated plate 17, a drier granulate 18 (partially illustrated) is introduced as a loose heap into the header 4. Above the granulate filling 18 is located a further perforated plate 19 which is moveable axially in the header 4 and which initially lies loosely on the granulate heap. This perforated plate 19 acts as a pressure place and is loaded by a compression spring 20 which is arranged above it and which is supported upwardly against a further perforated plate 21 which itself bears against projections 22 distributed over the circumference. The knob-like projections 22, which serve as abutments to the perforated plate 21, are introduced into the tubular piece 9 only after all the components 17 to 21 of the drier are positioned in the header 4.

The ready-mounting of these drier components, that is to say their final fixing in the header 4, takes place in that the uppermost perforated plate 21 is pressed downward by means of a ram, not illustrated, with the result that the spring 20 is prestressed and the granulate is likewise put under compressive stress. When the uppermost perforated plate 21 has reached its predetermined position, the knob-like projections 22 are pressed into the tubular piece 9 from outside by means of a suitable tool, and the perforated plate 21 can then be relieved as a result of the retraction of the ram and then comes to bear with its upper edge against the projections 22. Thus, owing to the prestress of the spring 20, all the drier components 17 to 21 are held in position between the two abutments 16, 22 and can subsequently be soldered to the entire condenser 1. The header 4 is previously closed upwardly by means of a cover, not illustrated.

The perforated plates 17, 19 are provided with a laid-on sieve fabric, not illustrated, which retains particles, such as granulate dust. The uppermost perforated plate 21 may also be designed as a ring, that is to say have on the inside a free cross section such that it performs merely the function of an abutment for the compression spring 20. Moreover, the two perforated plates 17, 19 may also be designed as annular sieves in the manner of the above-described annular sieve 12 and be fastened in the header 4.

In other design versions, the perforated plates or annular sieves may have a set-up edge in a similar way to a crucible or pot.

Figure 2:
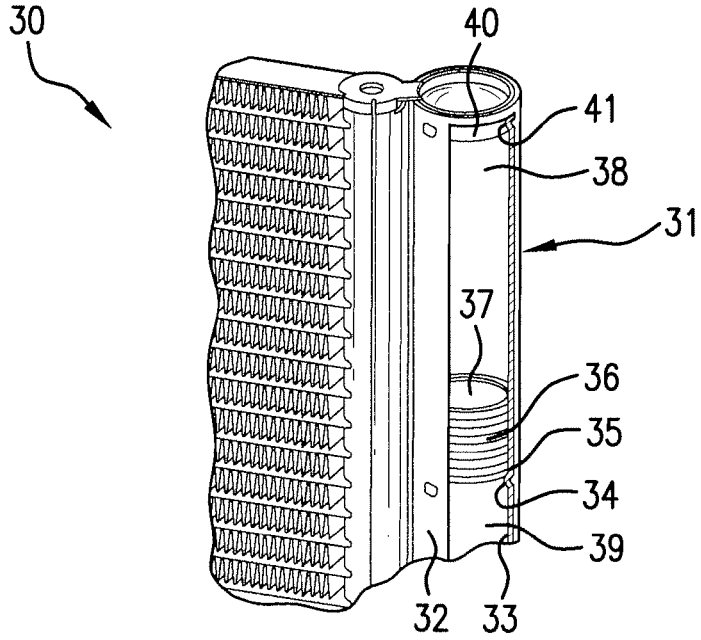

FIG. 2 shows a further exemplary embodiment of a heat exchanger 30 with a header 31. Projections 34 are introduced from outside into the inner wall 33 of a tubular housing 32 of the header by being pressed in, a ring 35 being laid onto said projections, a force accumulator in the form of a compression or helical spring 36 lies on the ring 35 and is itself covered by a sieve or separation element 37 designed as a fabric disk. For improved stability, the fabric disk 37 may have an edge region reinforced by means of condensed fabric. In a chamber 39 in the header housing 32, the separation element 37 divides off a drier region 38 in which a drier, not illustrated for the sake of greater clarity, is arranged. The drier is covered, in turn, by a second fabric disk 40 which is again supported by projections 41 of the inner wall 33. The individual components may be inserted into the header 31 both in the order described and in reverse order.

Figure 3:
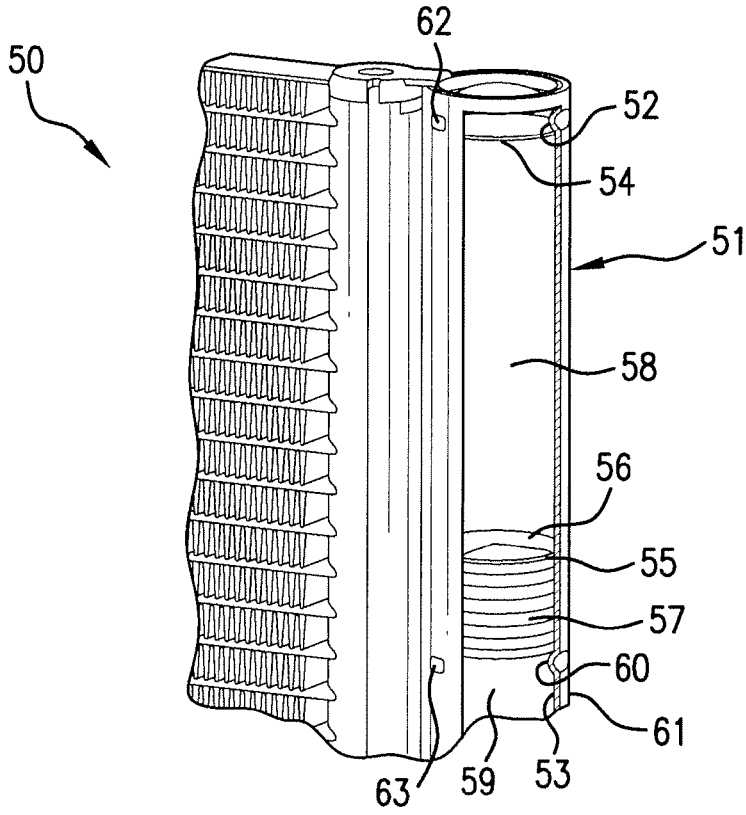

FIG. 3 shows a further exemplary embodiment of a heat exchanger 50 with a header 51. Here, first, projections 52 are introduced into a housing inner wall 53 of the header 51, and then a separation element 54 designed as a round metal sheet is supported on the projections 52, after which the header housing is filled with a drier, not illustrated. Subsequently, with the aid of a separation element 55 designed as a perforated plate, a fabric disk 56 is pushed into the header housing.

Preferably, the outer dimensions, here the diameter, of the fabric disk 56 are greater than the inner dimensions of the header housing, so that an outer edge of the fabric disk 56 comes to bear against an outer circumferential surface of the separation element 55, and the fabric disk 56 thus has a cup-shaped design and, with the aid of a subsequently introduced force accumulator 57 designed as a compression or helical spring, is pressed against the drier, with the result that the drier is fixed in the header 51 in a part of the chamber 59 which is separated as a drier region 58. Finally, to obtain a prestress acting on the force accumulator 57, projections 60 are introduced into the housing inner wall 53, the force accumulator 57 being supported on said projections. By the projections 52 or 60 being introduced into the housing inner wall 53 from outside, indentations 62 or 63 remain on the outside 61 of the header 51.

Figure 4:
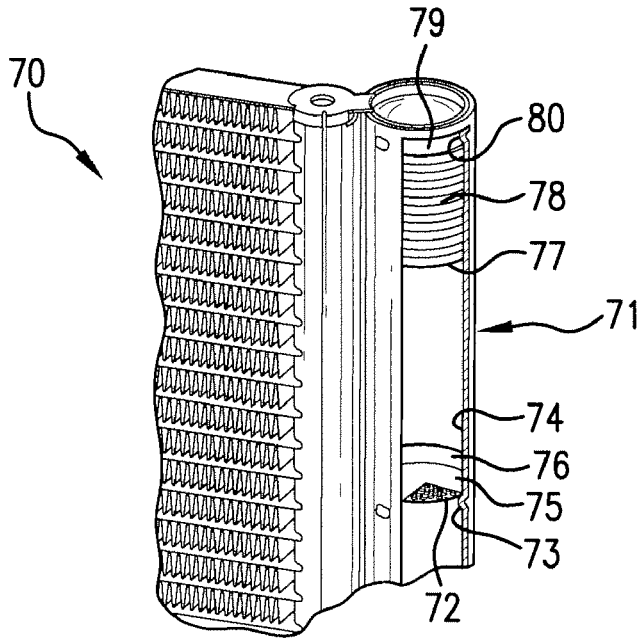

As illustrated in FIG. 4 it is also possible to premount a header 71 of a heat exchanger 70 as follows. A separation element 72 designed as a perforated plate is laid onto projections 73 in the housing inner wall 74 of the header 71. A fabric disk 75 is subsequently inserted into the header 71, the fabric disk 75 preferably having larger outer dimensions than the inner dimensions of the header housing, so that an edge region 76 of the fabric disk 75 can be set up and can be laid against the housing inner wall 74. It is advantageous to push the fabric disk 75 into the header 71 with the aid of a ram which is particularly preferably of internally hollow design, so that the ram can be used at the same time for filling the header with a drier which, in particular, is in granulate or powder form. In this case, the edge region 76 of the fabric disk 75 is advantageously pressed onto the housing inner wall 74 by the drier.

Finally, the drier, not shown, is covered by a further fabric disk 77 and fixed with the aid of a force accumulator 78, the force accumulator 78 being supported, and kept in the prestressed state, on projections 80 via a separation element 79 likewise designed as a fabric disk or as a sheet metal disk or as a sheet metal ring.

In an exemplary embodiment which is not illustrated, a force accumulator is supported directly on projections of a header housing inner wall, that is to say without an interposed separation element. A separation element is then provided by the fabric disk 77 in exactly the same way as in the exemplary embodiment of FIG. 4.

FIG. 5 shows a heat exchanger 90 with a header 91, in which a drier, not illustrated, is pressed with the aid of a force accumulator 92 and of a separation element 93 not against a further separation element, but, instead, against a housing cover 94 of the header 91. In order to prevent the housing cover 94 from falling out as a result of a force exerted by the force accumulator 92, it is possible to insert the housing cover 94 into the header with an exact fit, for example a firm connection between the housing cover and the header housing being made after a soldering operation. There is likewise the possibility of introducing projections into the housing inner wall 95, so that the housing cover 94 is fixed in a desired position. The projections may be introduced, for example, as beads or notches into the housing wall above the housing cover 94. The housing cover 94 may likewise be fixed by means of bent-round tabs. A further possibility for fixing the housing cover is completely or partially to contract the housing wall circumferentially above the housing cover 94.

FIG. 6 shows a detail of a further exemplary embodiment of a header 101 of a heat exchanger 100. Here, a separation element in the form of a fabric disk 102 is slipped over a force accumulator 103 designed as a compression spring, by the fabric disk 102 being pushed into the header with the aid of the force accumulator 103. This takes place, for example, in a similar way to the embodiments described with reference to FIG. 3 and FIG. 4.

Projections 104 are subsequently introduced into the housing inner wall of the header 101, so that the force accumulator 103 is supported. The shape of the force accumulator 103 must be adapted appropriately, that is to say the outer dimensions of the force accumulator 103 must be selected such that the force accumulator 103 is prevented from moving past the projections 104 by said projections.

In FIG. 7, a detail of a header 110 can be seen, in which a separation element 116 which has a perforated plate 111 is supported on projections 114 in the housing inner wall 115 of the header 110 via a force accumulator in the form of a cup spring 112 and via a holding ring 113. The separation element 116 has, furthermore, a fabric disk 117, so that a separation of a drier region 118 from an inner chamber of the header 110 is implemented. The fabric disk 117 is in this case, in particular, of resiliently elastic design and thus itself acts as a force accumulator, so that, in an exemplary embodiment which is not shown, the force accumulator 112 may under certain circumstances be omitted. The fabric disk 117 is advantageously produced from a temperature-resistant material, so that a soldering of the header which follows filling is possible. The fabric disk 117 may take the form, for example, of an insulating material mat or of a glass fiber mat.

FIG. 8 shows a detail of a heat exchanger 120, cut open for clarity, with tubes 121, ribs 122, a headpiece 123 and a header 124. Chambers 125, 126 are separated from one another or closed off outwardly in the tubular headpiece 123 by means of partitions 127, 128. The headpiece 123 and the header 124 are firmly connected to one another via a connection region 129, and are preferably produced in one piece with one another.

The header 124 has a return-flow chamber 130 and a forward-flow chamber 131, the return-flow chamber 130 communicating with the chamber 125 of the headpiece 123 via an inlet orifice 132, and the forward-flow chamber 131 communicating with the chamber 126 of the headpiece 123 via an outlet orifice 133. The return-flow chamber 130 and the forward-flow chamber 131 are separated from one another by means of a separation element 134 designed as a filter.

During operation, the flow passes through the heat exchanger 120 and the header 124 preferably as follows. Refrigerant from some of the tubes 121 is collected in the chamber 125 of the headpiece 123 and flows from there through the inlet orifice 132 into the return-flow chamber 130 of the header 124. In the header, a calming of the refrigerant, which under some circumstances is in the liquid and in the gaseous phase, occurs, so that preferably phase-pure refrigerant leaves the header. In the header, the refrigerant passes through the separation element 134 over into the forward-flow chamber 131 and is at the same time filtered, in that particles are caught in the separation element designed as a filter. A drier, not illustrated, in the return-flow chamber moreover extracts from the refrigerant undesirable water which under some circumstances is contained in the refrigerant. The refrigerant finally flows through the outlet orifice into the chamber 126 of the headpiece 123 and is distributed to some of the tubes 121.

The filter 134, which is designed, for example, as a fabric disk, is supported by means of a continuous projection 134 against movement in the direction of the forward-flow chamber and, via a spreading element 137 designed as a securing ring, is supported by means of a likewise continuous projection 136 against movement in the direction of the return-flow chamber. For this purpose, the preferably cup-shaped filter is first inserted into the header and is subsequently pressed with the aid of the spreading element 137 into a depression 135*a* formed between the projections 135 and 136.

In this case, the spreading element 137, on the one hand, assumes the task of fixing the separation element 134 and, on the other hand, presses a preferably set-up edge of the separation element 134 against the inner wall 138 of the header, preferably into the depression formed in the projections 135 and 136. In order to ensure such a pressing of the separation element 134 against the inner wall 138 of the header even in an open region 139 of the securing ring 137, the securing ring 137 may be tensioned after mounting, and may be rotated a little in the tensioned state, in order thereafter to be detensioned again. Under some circumstances, it is sufficient if the spreading element 137 is seated without prestress in the depression formed between the projections 135 and 136.

FIG. 9 illustrates a further exemplary embodiment of a heat exchanger 140 with a header 141, the header 141 having a housing 142 which consists essentially of two tubular parts 143, 144 plugged one into the other and of closing covers 145. The outer tubular part 143 has a projection 146 which supports a separation element 147 designed as a filter. With the aid of one end face of the inner tubular part 144, the separation element 147 is supported in the opposite direction. The housing 142 of the header 141 can be soldered jointly with the heat exchanger 140.

The filter 147 may be designed as a simple fabric disk, may have a condensed, reinforced or folded-round edge or, as shown in FIG. 9, may be framed in a ring 148. The ring 148 is preferably made from metal, so that it can be soldered to the header housing 142.

Figure 10:
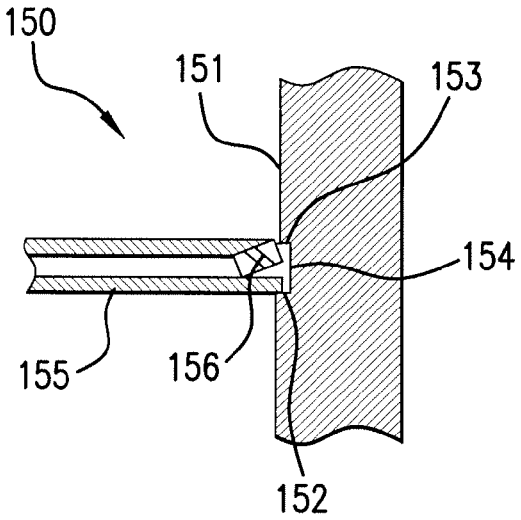

FIG. 10 shows a detail of a header 150 in cross section. A housing inner wall 151 of the header 150 has a first projection 152, a second projection 153 and a depression 154 lying between them. A separation element 155, for example a filter, lies on the first projection 152 and is pressed against the projection 152 with the aid of a conical ring 156.

Figure 11:
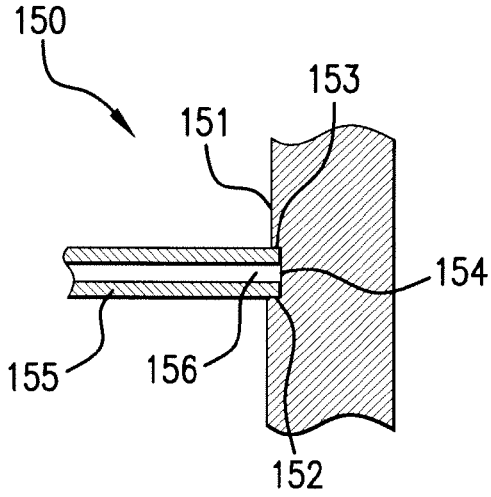

If, then, the conical ring 156 is pressed into the depression 154, an arrangement which is illustrated in FIG. 11 is obtained. The ring 156 is then supported by the projection 153, sealing off then being achieved by means of a circumferential bracing of the ring 156.

In a similar exemplary embodiment, a separation element is supported on both sides in this way by means of a braced ring, in which case a conical ring may also under certain circumstances be braced without a depression, that is to say only circumferentially, in the header housing.

FIG. 12 shows the detail of a header 160, the housing of which has at least two tubular parts 161, 162 in a similar way to the header 141 in FIG. 9. The two tubular parts are placed one on the other on the end face and connected to one another by a sleeve 163. A separation element 164 designed as a filter has an edge framed in a ring 165. The ring 165 is arranged between the mutually confronting end faces of the tubular parts 161, 162 and is thus held in its position.

The header 170 in FIG. 13 has a housing with an inner wall 171 and a separation element 172 which is supported on both sides in the inner wall 171 by means of projections 173, 174 introduced from outside. The projections 173, 174, designed as knobs, are arranged in two rows, in which case each knob row may likewise be designed as a continuous bead. The projections 173, 174 may be introduced into the inner wall of the header housing before and/or after insertion of the separation element into the header, in the first case the separation element having to be pressed past a row of projections. This signifies a particularly low outlay in manufacturing terms.

FIG. 14 shows a detail of a heat exchanger 180 with a header 181, in which a drier, not illustrated for the sake of greater clarity, is fixed in a drier region 182 without the aid of a force accumulator. The drier is held between a separation element 183 designed as a sieve and a housing cover 184 of the header 181. The separation element is supported in the inner wall 186 of the header housing by means of projections 185, whereas the housing cover 184 is secured against falling out by means of a formed housing end 187.

As can be seen in FIG. 14, the separation element 183 can be framed in a ring 188 which is laid onto the projections 185.

FIG. 15 shows an exemplary embodiment in which the separation element 191 is designed as a perforated plate 192 with a glass fiber coat 193 and is likewise laid onto projections 194 in a housing inner wall 195 of the header 190.

As regards the header 200 in FIG. 16, the separation element 201 is designed as a perforated plate cup 202 with a set-up edge region 203 and is likewise provided with a glass fiber coat 204. By means of a granulation and/or beading of the housing of the header at a point level with the separation element 201, the separation element 201 is secured against a change in position in the direction of the drier, not illustrated, or in the opposite direction.

The invention is likewise achieved by means of a heat exchanger and by means of a method having one or more of the following features.

A soldered refrigerant condenser, consisting of a heat exchanger network with flat tubes and corrugated ribs, of header tubes which are connected fluidically to the flat tubes and of a header which is arranged parallel to one of the header tubes and which preferably receives within it a drier and/or filter and is connected fluidically to the header tube via overflow orifices, the drier being designed as a space which receives a drying agent and which is delimited by a portion of the header and by two refrigerant-permeable inserts which pass through the cross section of the header and which are supported on at least one or more projections of the header.

A condenser, as before, characterized in that the projection or the projections is or are designed as a continuous bead or at least individual distributed projections.

A condenser, as before, characterized in that the projection or the projections is or are designed as bead segments distributed over the circumference of the header.

A condenser as before, characterized in that, between the inserts, an elastic element, such as, for example, a compression spring, is arranged, which is supported, on the one hand, against the upper insert and, on the other hand, against a moveable pressure plate which lies on the drier granulate and which presses the latter against the lower insert.

A condenser as before, characterized in that the lower insert is designed as a perforated plate with a laid-on or integrated sieve or sieve fabric.

A condenser as before, characterized in that the perforated plate is soldered circumferentially to the header.

A condenser as before, characterized in that the filter is arranged in the lower region of the header between the two overflow orifices and is designed as an annular sieve.

A condenser as before, characterized in that the annular sieve consists of an outer ring and of a framed planar sieve fabric.

A condenser as before, characterized in that the ring is inserted into a groove in the header.

A condenser as before, characterized in that the ring is connected to the header by frictional connection.

A condenser as before, characterized in that the ring is soldered circumferentially to the header.

A method for the production of a condenser as before, characterized in that, first, the projections in the lower region of the header are produced, in that the first insert is then laid onto the lower projections, in that, subsequently, granulate is introduced and is covered upwardly by means of the moveable pressure plate, in that the compression spring is positioned on the pressure plate and the second insert is positioned above it, in that the second insert is pressed down in the header from outside and the compression spring is prestressed, in that projections are introduced into the header above the second insert, and in that the second insert is relieved from outside and is pressed against the projections by the compression spring.

Finally, it may be emphasized that the features of the exemplary embodiments described above can be combined with one another in any desired way within the scope of the present invention.

The invention claimed is:

1. A header for a refrigerant of an air conditioning system, comprising:

a housing which has at least one inlet and at least one outlet orifice for the refrigerant, a chamber for receiving the refrigerant comprising at least one refrigerant-permeable separation element which separates a first region and a second region of the chamber from one another, wherein an inner wall of the housing has one or more, continuous or singly or multiply interrupted projections or depressions for supporting the separation element, and wherein the first region forms a return-flow chamber communicating with the inlet orifice and the second region forms a forward-flow chamber communicating with the outlet orifice, and in that the separation element has a filter or is designed as a filter.

2. The header as claimed in claim 1, wherein the filter comprises a filter fabric which has a reinforced edge region and/or is set in a frame connectable to the housing.

3. The header as claimed in claim 1, wherein a drier taking the form of granulate or powder can be received in the first region.

4. The header as claimed in claim 3, wherein the separation element has a sieve or is designed as a sieve.

5. The header as claimed in claim 4, wherein the sieve has a reinforced edge region and/or is set in a frame connectable to the housing.

6. The header as claimed in claim 3, wherein the drier can be fixed in the first region by means of a force accumulator.

7. The header as claimed in claim 1, wherein a depression for supporting the separation element is formed by a joint between two housing parts.

8. The header as claimed in claim 1, wherein the separation element can be supported against movement away from the first region.

9. The header as claimed in claim 1, wherein the separation element can be supported against movement toward the first region.

10. The header as claimed in claim 1, wherein the separation element can be supported by means of a force accumulator, the force accumulator designed as a compression spring, cup spring, or as a securing ring.

11. The header as claimed in claim 1, wherein the separation element can be connected in a materially integral manner to the housing.

12. The header as claimed in claim 1, wherein the housing is designed as a closed tube, wherein the closed tube is a round tube, with at least one inlet orifice and at least one outlet orifice.

13. A heat exchanger comprising tubes, ribs and two head pieces, wherein the heat exchanger has a header as claimed in claim 1.

14. A refrigerant circuit of an air conditioning system comprising: a compression element, a first heat exchanger, an expansion element, a second heat exchanger, and a header, wherein the header is designed as claimed in claim 1.

15. A method for the production of a header for a refrigerant of an air conditioning system, the header comprising:

a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element; the method comprising:

first, introducing one or more projections into a housing inner wall of the header, laying a separation element onto a support, introducing and covering a drier by means of a force distributor, wherein the force distributor is a moveable pressure plate, positioning a force accumulator, wherein the force accumulator is a compression spring, on the drier or the force distributor, positioning a second separation element or a housing wall on the force accumulator, pressing down the force accumulator, the second separation element, or the housing wall in the housing from outside and the force accumulator is prestressed, introducing one or more further projections into the housing inner wall above the force accumulator, the second partition or the housing wall, and relieving the force accumulator from outside, and pressing the force accumulator against the further projections or the second partition or pressing the housing wall against the further support by the force accumulator.

16. A method for the production of a header for a refrigerant of an air conditioning system, the header comprising:

a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element; the method comprising:

introducing a drier into a housing and covering by a force distributor, wherein the force distributor is a moveable pressure plate, positioning a force accumulator on the drier or the force distributor, wherein the force accumulator is a compression spring, and positioning a separation element on said compression spring, pressing the separation element down in the housing from outside and prestressing the force accumulator, introducing one or more projections into a housing inner wall of the header above the separation element, relieving the separation element from outside and pressing against the projections by the force accumulator, and closing the housing.

17. A method for the production of a header for a refrigerant of an air conditioning system, the header comprising:

a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element; the method comprising:

introducing a drier into a housing and covering by a separation element designed as a force distributor, wherein the force distributor is a moveable pressure plate, positioning a force accumulator, wherein the force accumulator is a compression spring, on the separation element, pressing down the force accumulator in the housing from outside and the force accumulator is prestressed, introducing one or more projections into a housing inner wall of the header above the force accumulator, relieving the force accumulator from outside and pressing the force accumulator against the projections, and closing the housing.

18. A method for the production of a header for a refrigerant of an air conditioning system, the header comprising:

a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element the method comprising:

introducing a drier into a housing and covering by a separation element, pressing down the separation element in the housing from outside, introducing one or more projections into a housing inner wall of the header above or level with the separation element, relieving the separation element from outside and is supported by the projections, and closing the housing.

19. A condenser consisting of a heat exchanger network with flat tubes and corrugated ribs, header tubes which are connected fluidically to the flat tubes, and a header arranged parallel to one of the header tubes and receives within it a drier and/or filter and is connected fluidically to the header tube via overflow orifices, the drier designed as a space which receives a drying agent and which is delimited by a portion of the header, and by two refrigerant-permeable inserts which pass through the cross section of the header and are supported on at least one or more projections of the header, wherein the header comprises a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element.

20. The condenser as claimed in claim 19, wherein the projection or the projections are designed as a continuous bead or at least individual distributed projections.

21. The condenser as claimed in claim 19, wherein the projection or the projections are designed as bead segments distributed over the circumference of the header.

22. The condenser as claimed in claim 19, wherein between the inserts, an elastic element, wherein the elastic element is a compression spring, is arranged, and is supported against the upper insert and against a moveable pressure plate on the drier granulate and which presses the latter against the lower insert.

23. The condenser as claimed in claim 19, wherein the lower insert is a perforated plate with a laid-on or integrated sieve or sieve fabric.

24. The condenser as claimed in claim 19, wherein the perforated plate is soldered circumferentially to the header.

25. The condenser as claimed in claim 19, wherein the filter is arranged in the lower region of the header between the two overflow orifices and is designed as an annular sieve.

26. The condenser as claimed in claim 19, wherein the annular sieve consists of an outer ring and of a framed planar sieve fabric.

27. The condenser as claimed in claim 19, wherein the ring is inserted into a groove in the header.

28. The condenser as claimed in claim 19, wherein the ring is connected to the header by frictional connection.

29. The condenser as claimed in claim 19, wherein the ring is soldered circumferentially to the header.

30. A method for the production of a condenser comprising a header comprising:

a housing which has at least one inlet and at least one outlet orifice for the refrigerant, a chamber for receiving the refrigerant comprising at least one refrigerant-permeable separation element which separates a first region and a second region of the chamber from one another, and wherein an inner wall of the housing has one or more, continuous or singly or multiply interrupted projections or depressions for supporting the separation element: the method comprising:

first, producing the projections in the lower region of a header, laying the first insert onto the lower projections, introducing granulate and covering upwardly by a moveable pressure plate, positioning the compression spring on the pressure plate and positioning the second insert above it, pressing down the second insert in the header from outside and the compression spring is prestressed, introducing projections into the header above the second insert, and relieving the second insert is relieved from outside and pressing the second insert against the projections by the compression spring.

* * * * *